US009808693B2

(12) United States Patent
DeLaRosa

(10) Patent No.: US 9,808,693 B2
(45) Date of Patent: Nov. 7, 2017

(54) KICKING AND PUNCHING APPARATUS

(71) Applicant: Dan DeLaRosa, Coral Springs, FL (US)

(72) Inventor: Dan DeLaRosa, Coral Springs, FL (US)

( * ) Notice: Subject to any disclaimer, the term of this patent is extended or adjusted under 35 U.S.C. 154(b) by 0 days.

(21) Appl. No.: 14/756,504

(22) Filed: Sep. 11, 2015

(65) Prior Publication Data

US 2016/0074729 A1 Mar. 17, 2016

Related U.S. Application Data

(60) Provisional application No. 62/071,011, filed on Sep. 12, 2014.

(51) Int. Cl.
*A63B 69/34* (2006.01)
*A63B 69/00* (2006.01)

(52) U.S. Cl.
CPC ..... *A63B 69/004* (2013.01); *A63B 69/34* (2013.01); *A63B 2244/10* (2013.01)

(58) Field of Classification Search
CPC . A63B 69/004; A63B 69/34; A63B 2244/102; A63B 69/24; A63B 69/203; A63B 69/26; A63B 21/169
USPC ..... 482/83–90
See application file for complete search history.

(56) References Cited

U.S. PATENT DOCUMENTS 5,281,191 A * 1/1994 DeSousa ..... A63B 69/34 473/442
5,700,230 A * 12/1997 Cardona ..... A63B 69/34 482/83
D410,986 S * 6/1999 Luedke ..... D20/31
5,971,398 A * 10/1999 Broussard ..... A63B 69/34 273/408
6,155,960 A * 12/2000 Roberts ..... A63B 69/34 482/83
6,942,585 B1 * 9/2005 Krause ..... A63B 69/002 473/441
2002/0077223 A1 * 6/2002 Zai ..... A63B 71/0605 482/83
2008/0026917 A1 * 1/2008 Campana ..... A63B 69/34 482/83
2008/0182729 A1 * 7/2008 Ziska ..... A63B 69/34 482/89
2009/0082179 A1 * 3/2009 Le ..... A63B 69/004 482/88
2011/0111924 A1 * 5/2011 Jones ..... A63B 69/32 482/8
2013/0205480 A1 * 8/2013 Nagely ..... A63B 71/1291 2/425
2013/0296141 A1 * 11/2013 Partlo ..... A63B 69/34 482/84
2014/0315665 A1 * 10/2014 Hall ..... A63B 69/345 473/445
2015/0018174 A1 * 1/2015 Partlo ..... A63B 69/201 482/87
2015/0157913 A1 * 6/2015 McCranor ..... A63B 69/004 482/84

* cited by examiner

*Primary Examiner* — Andrew S Lo
(74) *Attorney, Agent, or Firm* — Dan DeLaRosa

(57) ABSTRACT

The present invention provides for a taekwondo kicking and punching apparatus comprising: a first padded element designed like an Olympic style taekwondo chest protector; a paddle having a handle on one end and a padded portion designed to look like an Olympic style helmet; and a device for securing the paddle to the first padded element.

18 Claims, 8 Drawing Sheets

KICKING AND PUNCHING APPARATUS

RELATED APPLICATION

This application is related to U.S. Provisional Patent Application Ser. No. 62/071,011 filed on Sep. 12, 2014 entitled "Kicking and Punching Apparatus".

BACKGROUND OF THE INVENTION

Field of the Invention

This invention relates to a kicking and/or punching apparatus and more specifically, to kicking bag designed to practice Olympic style taekwondo kicking and/or punching techniques including head shots.

Description of the Related Art

There are various patents covering kicking bags but most do not simulate Olympic style or sport taekwondo kicking and/or punching techniques.

SUMMARY OF THE INVENTION

In one embodiment, the present invention provides for a kicking apparatus comprising: a first padded portion having front and rear portions, the front portion is designed to look like an Olympic style taekwondo chest protector, the rear portion comprises at least one adjustable strap and at least one handle, the rear portion has a connection device designed to receive a second portion; and a second portion having two opposing ends, a first end comprises a handle, a second end comprising a padded element and is designed to look like an Olympic style taekwondo helmet, and the first end further comprises an attachment device designed to connect with the connection device of said first padded portion so that said second portion is secured to the first padded portion and the padded element of the second portion is exposed for kicking during use.

In another embodiment, the first padded portion comprises top and bottom sides, and the connection device is situated adjacent the top side of said first padded portion. In yet another embodiment, the first padded portion comprises a striking bag. In still another embodiment, the second portion comprises a paddle.

In a further embodiment, the strap is generally parallel of the top side of the first padded portion. In yet a further embodiment, the handle is rotatable to be generally diagonal relative to the strap. In still a further embodiment, the apparatus further comprises a second strap attached to the rear portion of the first padded portion and is generally perpendicular of the strap. In still yet a further embodiment, the strap is rotatable to various positions. In another further embodiment, the handle is rotatable to various positions.

In another embodiment, the present invention relates to a kicking apparatus comprising: a first padded portion having front and rear portions; the first padded portion is designed to look like an Olympic style taekwondo chest protector, the rear portion comprise a mechanism for holding the apparatus, and the rear portion has a connection device designed to receive a second portion, the first padded portion is designed for simulating kicks to an opponent's body; and a second portion having two opposing ends, a first end comprises a handle, a second end comprising a padded element and is designed to look like an Olympic style taekwondo helmet, the first end is designed to be attached to the first padded portion using the connection device and to simulate kicks to the opponent's head.

In yet another embodiment, the mechanism for holding the apparatus is selected from a group comprising straps, handles, hooks, grips and mixtures thereof. In still another embodiment, the mechanism for holding the apparatus is rotatable to a desired position. In still yet another embodiment, the first padded portion and the second portion may be detached from one another and used separately.

In another further embodiment, the present invention illustrates a taekwondo apparatus comprising: a first padded element designed like an Olympic style taekwondo chest protector; a paddle having a handle on one end and a padded portion designed to look like an Olympic style helmet; and a device for securing the paddle to the first padded element.

In a further embodiment, the padded portion of the paddle comprises a molded helmet. In another further embodiment, the first padded element comprises a molded chest protector. In another embodiment, the device for securing the paddle to the first padded portion is selected from a group comprising snap-on devices, interlocking devices, straps, hooks, and combinations thereof.

In another embodiment, the present invention provides for a bottom padded body portion with an attached head portion designed to simulate an Olympic sport taekwondo opponent. In a further embodiment, the head portion is integral to the body portion. In another further embodiment, the body portion is shaped or designed to look like a chest protector or hogu. In yet another further embodiment, the head portion has or is designed to look like a head with a helmet. The helmet can be drawn on or molded to look like a head with a helmet. In still another further embodiment, the head portion is attached to the body with a spring.

In another embodiment, the present invention provides for a taekwondo apparatus comprising: a first padded element designed like an Olympic sport taekwondo chest protector; and a second padded element designed to look like an Olympic sport helmet, and the second padded element is attached to the first padded element and is designed to look like an Olympic sport taekwondo opponent.

In yet another embodiment, the second padded element comprises a molded helmet. In still another embodiment, the first padded element comprises a molded chest protector. In still yet another embodiment, the apparatus comprises a means for the user to hold the device, and the means are selected from a group comprising grips, straps, belts and combinations thereof. In a further embodiment, the apparatus further comprises at least one spring situated within the first and second padded members.

In another further embodiment, the apparatus is designed to be held by the user's arms and hands and supported on the user's hips and legs to thereby allow an athlete to kick and punch the first and second padded members. In yet a further embodiment, the artwork of the chest protector and the helmet are placed upon the first and second padded members.

BRIEF DESCRIPTION OF THE DRAWINGS

The accompanying drawings are included to provide a further understanding of the present invention. These drawings are incorporated in and constitute a part of this specification, illustrate one or more embodiments of the present invention and together with the description, serve to explain the principles of the present invention.

Figure 1:
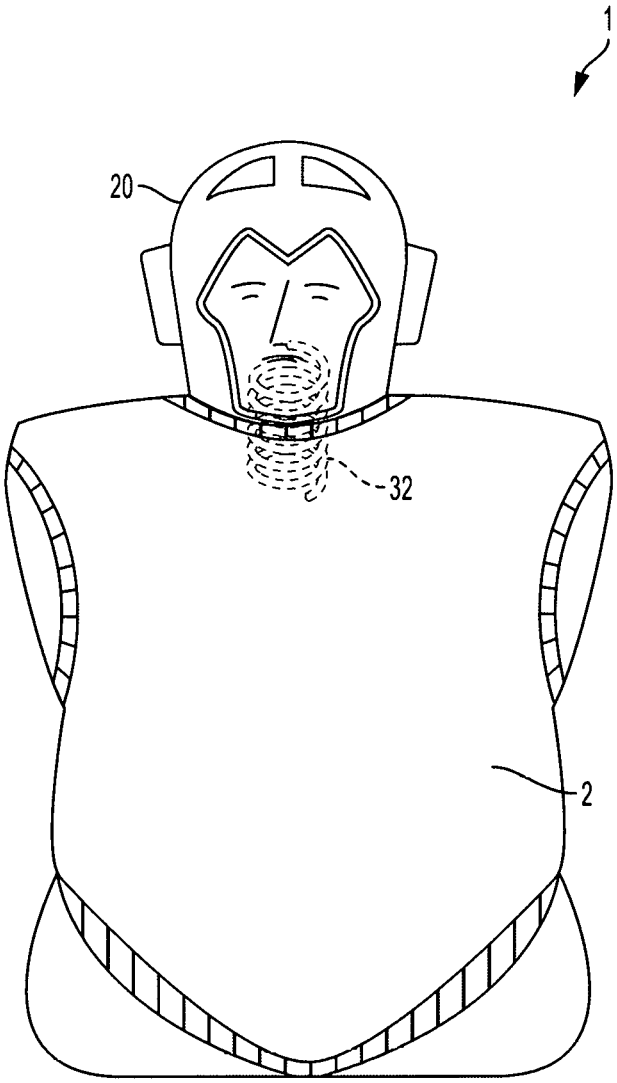
FIG. 1 is a front view of one of the embodiments of the apparatus.
Figure 2:
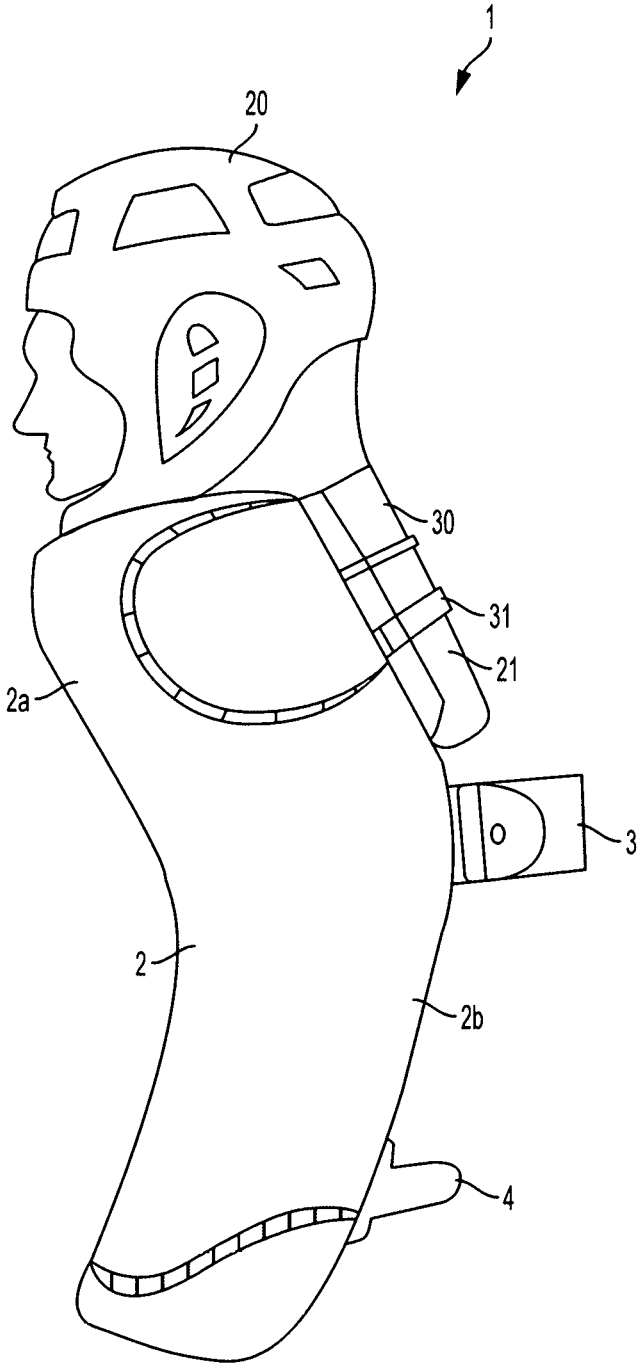
FIG. 2 is a side view of FIG. 1 showing the attachment of the paddle to the kicking pad.
Figure 3:
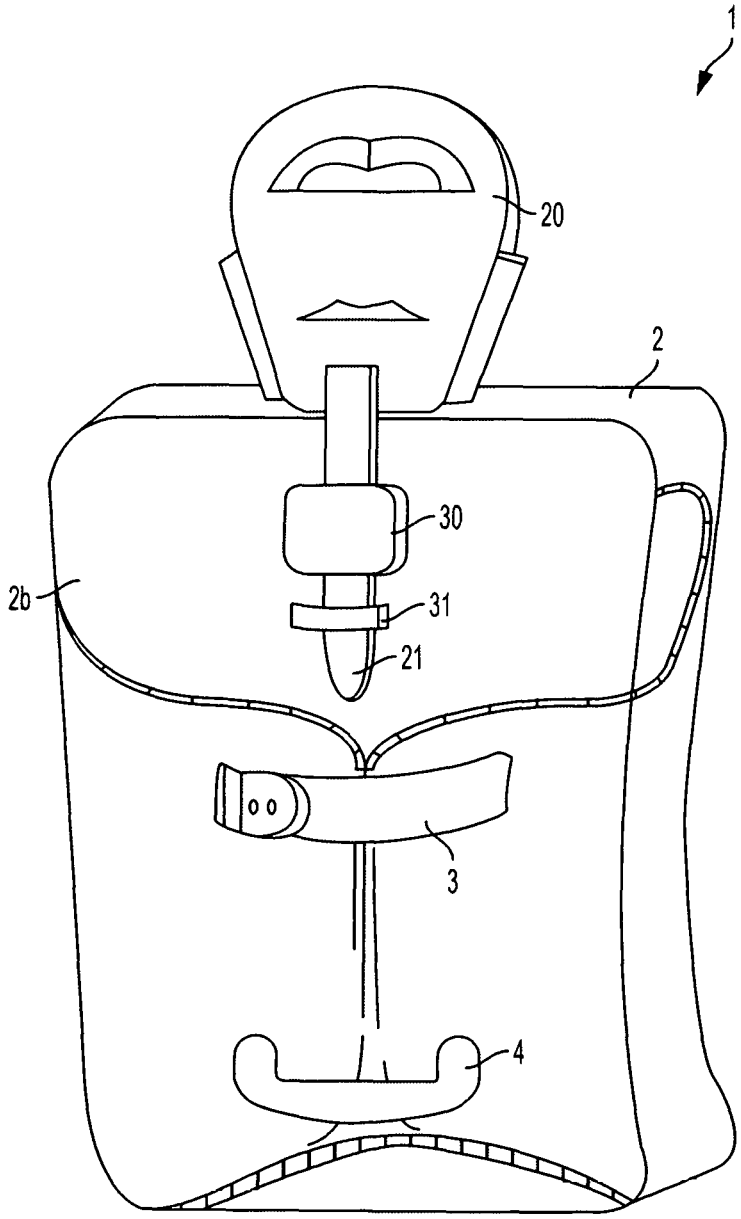
FIG. 3 is rear view of FIG. 1 showing the attachment device, connection device, a strap and a handle.
Figure 4:
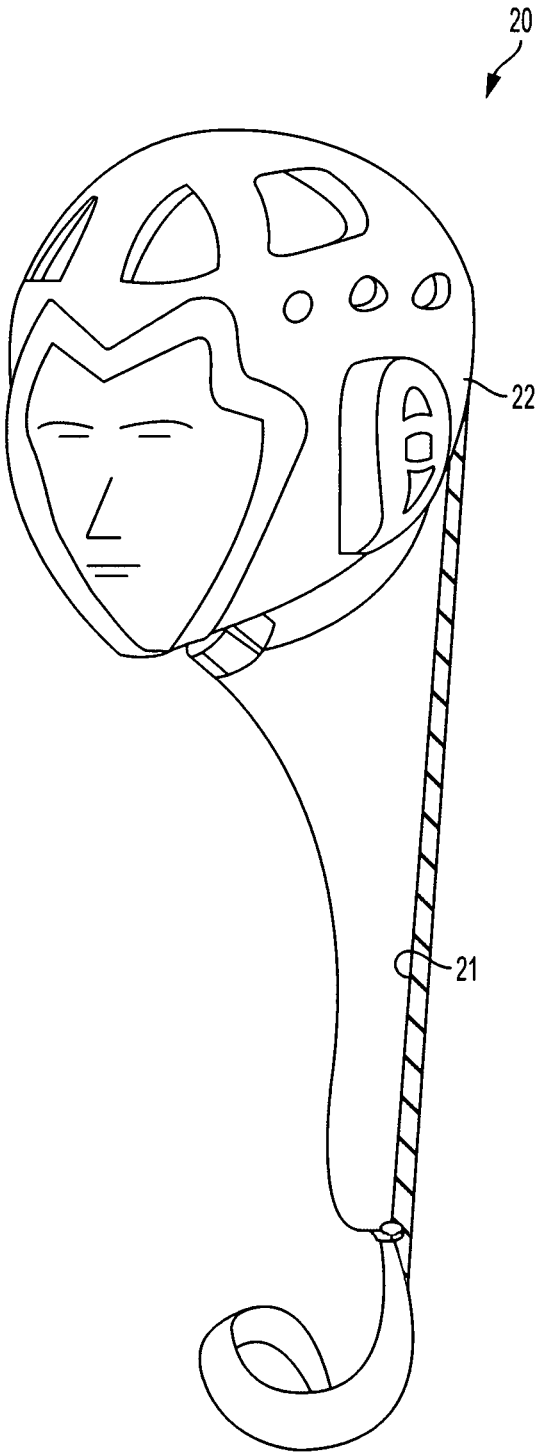
FIG. 4 is a front perspective view of the paddle.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

DETAILED DESCRIPTION OF THE INVENTION

As required, detailed embodiments of the present invention are disclosed herein; however, it is to be understood that the disclosed embodiments are merely exemplary of the invention that may be embodied in various forms. The figures are not necessarily to scale, some features may be exaggerated to show details of particular components. Therefore, specific structural and functional details disclosed herein are not to be interpreted as limiting, but merely as a basis for the claims and as a representative basis for teaching one skilled in the art to variously employ the present invention.

FIGS. 1-4 show a kicking apparatus 1 comprising: a first padded portion 2 having front and rear portions, 2*a* and 2*b* respectively. The front portion 2*a* is designed to look like an Olympic style taekwondo chest protector, and the rear portion comprises at least one adjustable strap 3 and at least one handle 4. The rear portion 2*b* has a connection device 30 designed to receive a second portion 20; and a second portion (or paddle) 20 having two opposing ends, a first end comprises a handle 21, a second end comprising a padded element 22 and is designed to look like an Olympic style taekwondo helmet, and the first end 21 further comprises an attachment device 31 designed to connect with the connection device 30 of the first padded portion 2 so that the second portion 20 is secured to the first padded portion 2 and the padded element 22 of the second portion 20 is exposed for kicking during use.

Figure 5:
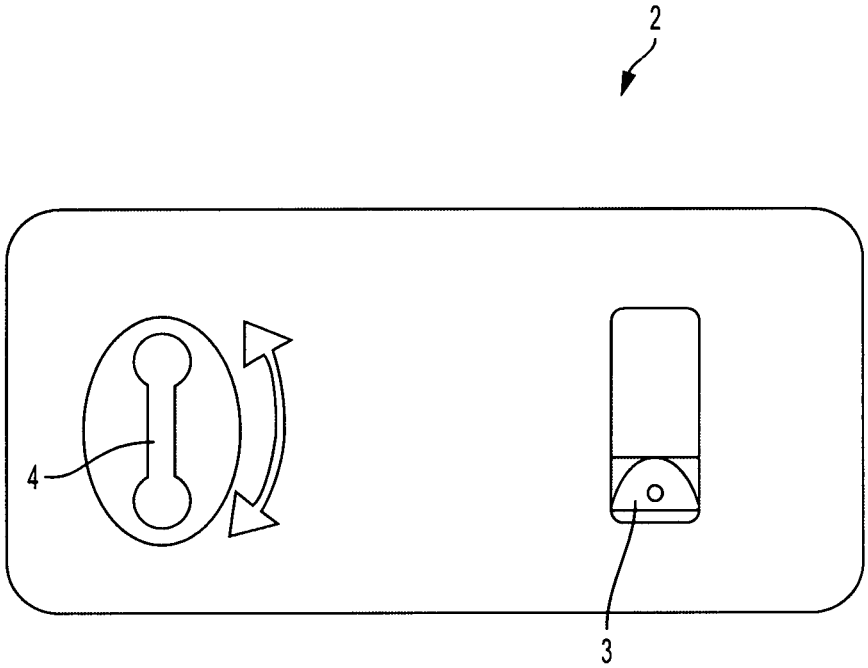
FIG. 5 is a rear view of one of the embodiments of the present invention showing the handle and strap configuration.
Figure 6:
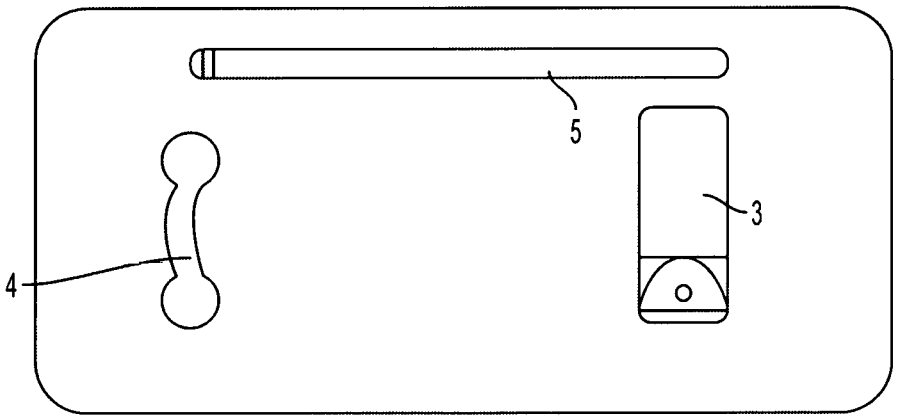
FIG. 6 is a rear view of another embodiment of the present invention showing the handle and double strap configuration.
Figure 7:
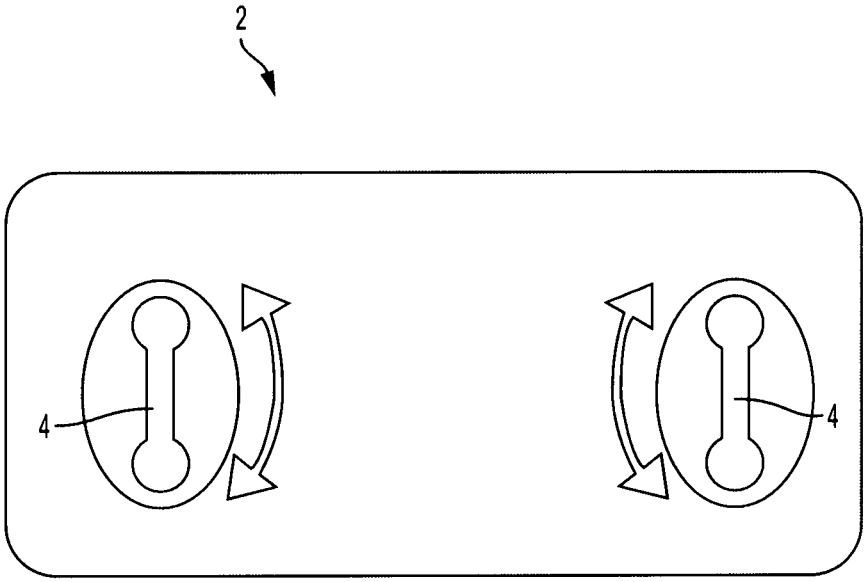
FIG. 7 is a rear view of a further embodiment of the present invention showing the double handle configuration.

FIG. 5 depicts the strap 3 and movable handle 4 configuration on one of the embodiments of the present invention. The handle can be moved and locked to a desired position. FIG. 6 shows the double straps, 3 and 5 respectively, and single handle 4 configuration with a non-movable handle. FIG. 7 shows the double movable handles 4 configuration which allows the user to move the handles to a desired position.

FIGS. 8*a-b* and 9*a-b* depict images of the integral kicking apparatus. The taekwondo apparatus 100 comprises: a first padded element 101 designed like an Olympic sport taekwondo chest protector; and a second padded element 102 designed to look like an Olympic sport helmet, and the second padded element 102 is attached to the first padded element 101 and is designed to look like an Olympic sport taekwondo opponent. The apparatus 100 comprises straps 103 or means for the user to hold the apparatus on the backside of the first padded element 101.

Figure 8A:
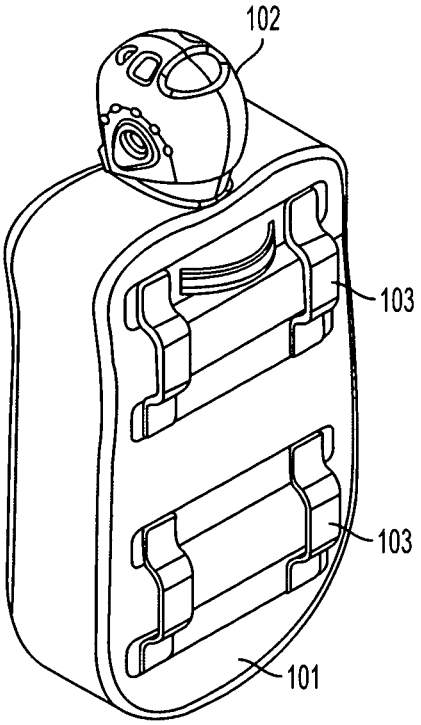
FIGS. 8*a-b* are front and rear perspective views of the kicking apparatus with an integral molded head with helmet.
Figure 8B:
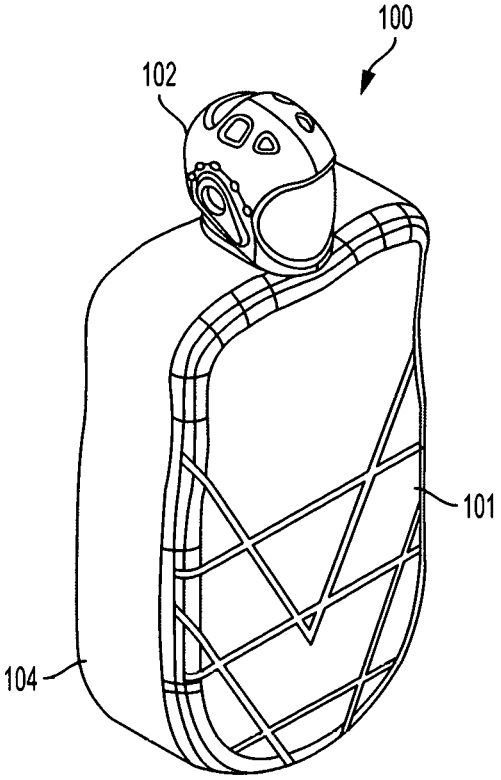
Figure 9A:
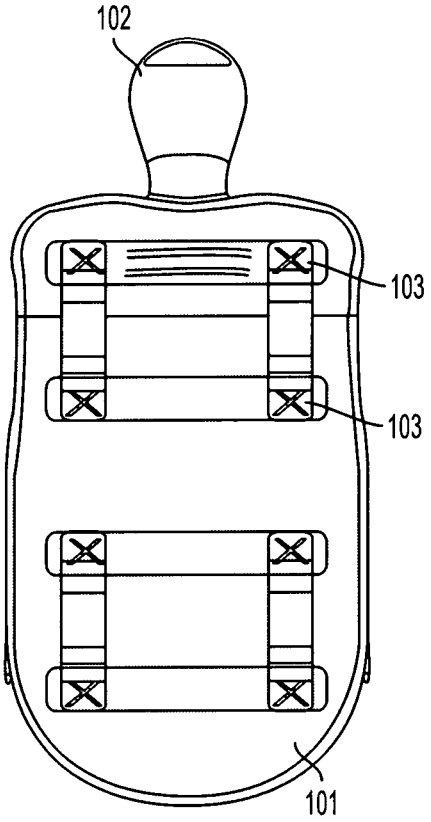
FIGS. 9*a-b* are front and rear perspective views of the kicking apparatus with an integral head member with artwork depicting the helmet and chest protector.
Figure 9B:
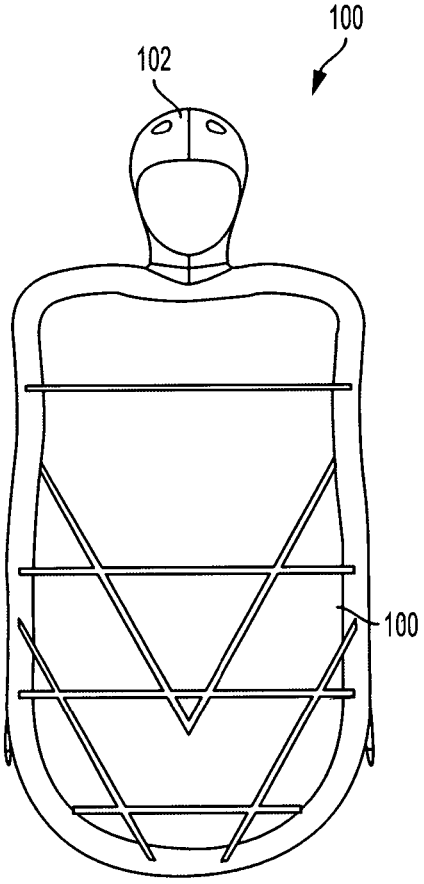

FIG. 8*a* shows finger handles 104 situated on the side of the first padded element which allows the user to grasp the side of the apparatus.

Numerous modifications and variations of the present invention are possible in light of the above teachings. It is therefore to be understood that within the scope of the attendant claims attached hereto, this invention may be practiced otherwise than as specifically disclosed herein.

What is claimed is:

1. A taekwondo apparatus comprising:

a padded portion designed to look like an Olympic sport taekwondo chest protector and simulate a body, said padded portion comprises a connection device; and a paddle having two opposing ends, a first end comprises a rigid, elongated handle extending away from a second padded end which is designed to look like an Olympic sport helmet, wherein in a first use position, at least a portion of said rigid, elongated handle of said paddle is attached to said padded portion using said connection device and the apparatus is configured to look like a head and body of an Olympic sport taekwondo opponent, wherein in a second use position, said paddle is detached from said padded portion and said rigid, elongated handle is configured to be held by a holder and said padded end of said paddle is configured to be kicked by an athlete.

2. The apparatus of claim 1 wherein said padded end of said paddle comprises a molded helmet.

3. The apparatus of claim 1 wherein said padded portion comprises a molded chest protector.

4. The apparatus of claim 1 wherein said apparatus comprises a means for the holder to hold the padded portion, said means are selected from a group comprising grips, straps, belts and combinations thereof.

5. The apparatus of claim 1 wherein the apparatus is designed to be held by the holder's arms and hands and supported on the holder's hips and legs to thereby allow an athlete to kick and punch said padded portion and said padded end of said paddle.

6. The apparatus of claim 1 wherein artwork of the chest protector and the helmet are placed upon said padded portion and said padded end of said paddle.

7. A kicking apparatus comprising:

a first portion having front and rear portions and is padded, said front portion is designed to look like an Olympic style taekwondo chest protector, said rear portion comprises at least one adjustable strap and at least one handle, said rear portion comprises a connection device; and a second portion comprises a paddle having two opposing ends, a first end comprises a rigid, elongated handle extending to a second end, said second end comprising a padded element, said padded element is designed to look like an Olympic style taekwondo helmet, wherein in a first use position, said connection device attaches said rigid, elongated handle of said second portion to said first portion thereby allowing said padded element to sit atop said first portion thereby creating a simulated head and body to be used for punching and kicking, wherein in a second use position, said second portion is separated from said first portion and said rigid, elongated handle of said second portion is configured to be held by a holder and said padded element is configured to be kicked by an athlete.

8. The apparatus of claim 7 wherein said first portion comprises top and bottom sides, said connection device is situated adjacent said top side of said first portion.

9. The apparatus of claim 7 wherein said first portion comprises a striking bag.

10. The apparatus of claim 8 wherein said adjustable strap is generally parallel of said top side of said first portion.

11. The apparatus of claim 10 wherein said handle of the first portion is rotatable to be generally diagonal relative to said adjustable strap.

12. The apparatus of claim 10 further comprising a second strap attached to said rear portion of said first portion and is generally perpendicular of said adjustable strap.

13. The apparatus of claim 7 wherein said adjustable strap is rotatable to various positions.

14. The apparatus of claim 7 wherein said handle of the first portion is rotatable to various positions.

15. The apparatus of claim 7 wherein said first portion and said second portion may be detached from one another and used separately.

16. A kicking apparatus comprising:

a first portion having front and rear portions and is padded, said first portion is designed to look like an Olympic style taekwondo chest protector, said rear portion comprise a mechanism for holding said apparatus, said rear portion has a connection device configured to receive a second portion, said first portion is configured for simulating kicks to an opponent's body; and said second portion comprising a paddle having two opposing ends, a first end comprises a rigid, elongated handle extending to a second end, said second end comprising a padded element, said padded element is designed to look like an Olympic style taekwondo helmet, wherein in a first use position, said rigid, elongated handle of said second portion is configured to be attached to said first portion using said connection device thereby allowing said padded element of said second portion to sit atop said first portion thereby creating a simulated head and body to be used for punching and kicking, wherein in a second use position, said second portion is detached from said first portion and said rigid, elongated handle is configured to be held by a holder and said padded element of the second portion is configured to simulate kicks to the opponent's head.

17. The apparatus of claim 16 wherein said mechanism for holding said apparatus is selected from a group comprising straps, handles, hooks, grips and mixtures thereof.

18. The apparatus of claim 17 wherein said mechanism for holding said apparatus is rotatable to a desired position.

* * * * *